United States Patent [19]

Eller

[11] 4,070,135

[45] Jan. 24, 1978

[54] MOBILE PUMPING APPARATUS

[76] Inventor: J. Marlin Eller, 204 NE. 8 Terrace, Deerfield Beach, Fla. 33441

[21] Appl. No.: 760,833

[22] Filed: Jan. 21, 1977

[51] Int. Cl.[2] ..... F04B 21/00

[52] U.S. Cl. ..... 417/234; 37/72; 37/58

[58] Field of Search ..... 417/234, 231, 408, 409; 37/72, 58; 214/1 P

[56] References Cited

U.S. PATENT DOCUMENTS

| | | | |
|---|---|---|---|
| 1,019,610 | 3/1912 | Donnelly | 37/67 |
| 3,008,422 | 11/1961 | Crisafulli | 417/234 |

*Primary Examiner*—Carlton R. Croyle
*Assistant Examiner*—Richard E. Gluck
*Attorney, Agent, or Firm*—Oltman and Flynn

[57] ABSTRACT

The present apparatus includes a mobile cart which supports a winch at one end and a pulley at the opposite end for operating a cable to raise and lower a submersible pumping unit. The submersible pumping unit comprises a rigid discharge pipe supported from below near one end by a pipe support on a slide on the cart. The slide has a horizontal transverse pivot which enables the pipe support to accomodate the tilting of the discharge pipe as its opposite intake end is lowered or raised. The cart carries an engine driving a pump which operates a hydraulic motor for the winch. A basket on the cart holds a flexible discharge hose for attachment to the discharge end of the discharge pipe. The engine-driven pump on the cart is connected through hydraulic lines to a hydraulic motor in the submersible pumping unit, which motor drives a pump inside the discharge pipe near its intake end.

27 Claims, 10 Drawing Figures

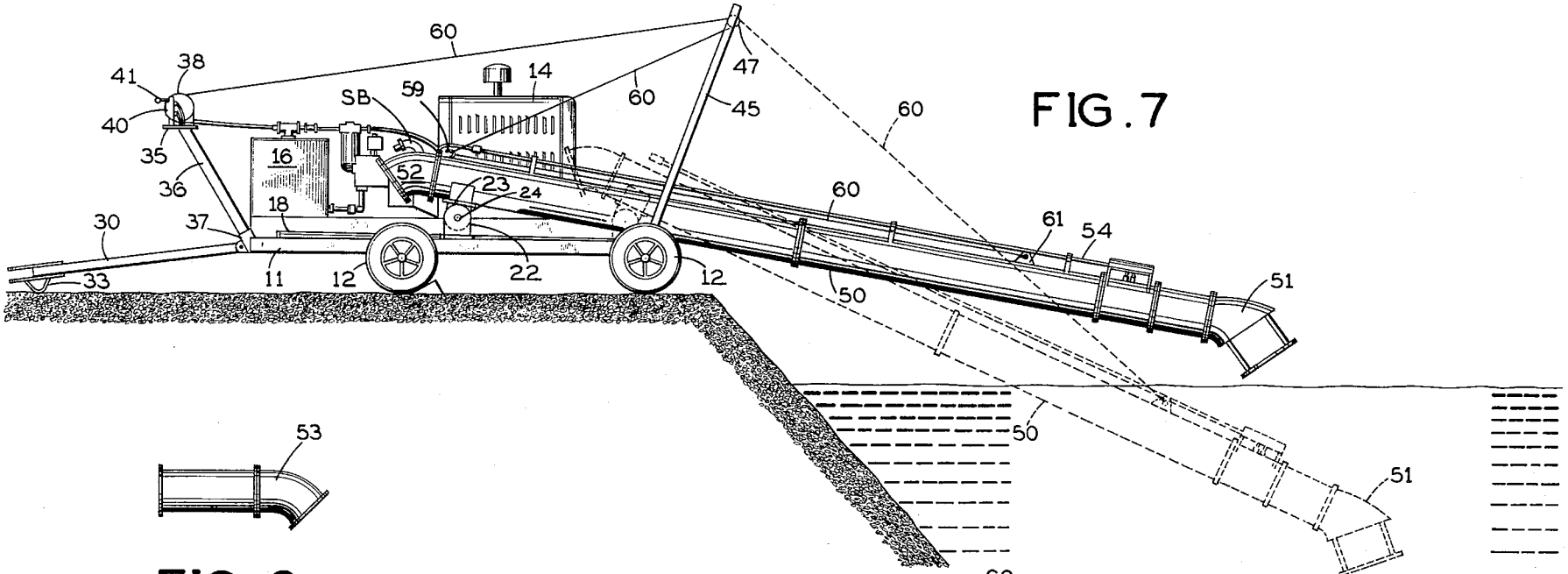
FIG. 7
FIG. 8
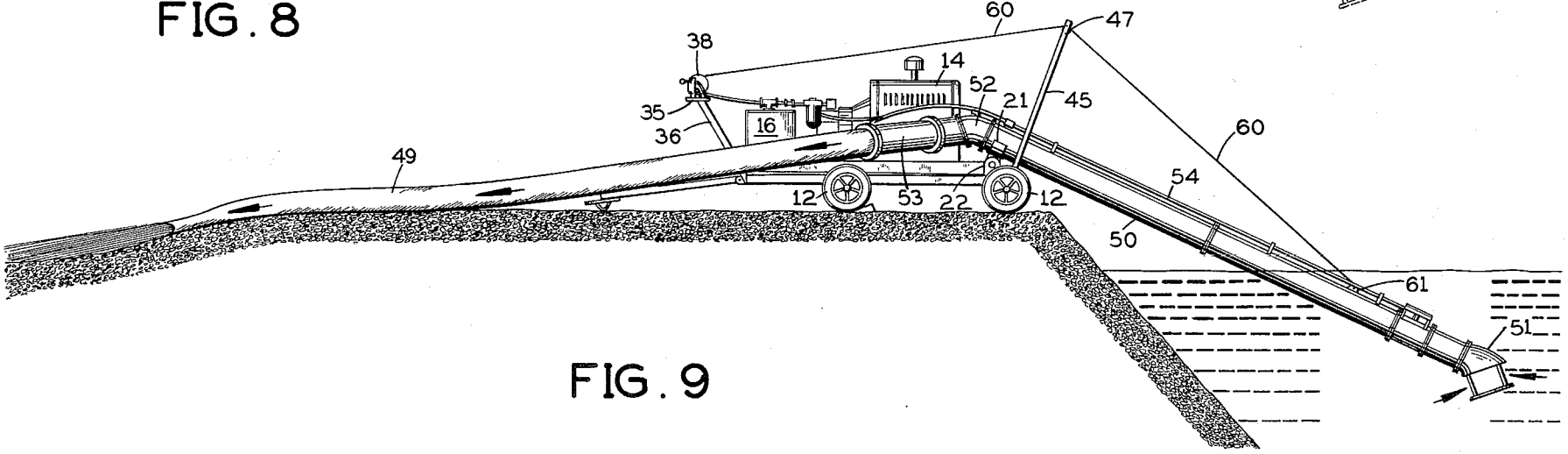
FIG. 9

MOBILE PUMPING APPARATUS

BACKGROUND OF THE INVENTION

Various arrangements have been proposed heretofore for pumping water out of an excavation, ditch or other ground site. For this purpose various submersible pumping units have been used, usually having a relatively large diameter, rigid discharge pipe with a pump near its lower, intake end. Preferably, the submersible pump was driven by a hydraulic motor, but in some instances a sealed electric motor was used for this purpose.

Submersible pumping units of this general type tend to be unwieldy and difficult to handle at the pumping site while being lowered into the water before the pumping operation begins or while being raised from it after the pumping operation has ended.

SUMMARY OF THE INVENTION

The present invention is directed to a mobile pumping apparatus which is simpler and safer to handle, making it possible for one man to lower an elongated, submersible pumping unit into the water to any desired level and to raise it from the water.

The present apparatus has a wheeled cart on which a motordriven winch and a pulley are mounted respectively at opposite ends. A cable extends from the winch over the pulley for attachment to the submersible pumping unit toward the latter's intake end. Near its opposite end the submersible pumping unit has a hook around which the cable extends when this unit is being lowered into the water. At this end the submersible pumping unit rests on a cradle carried by a pivotally articulated slide which is slidable along the cart from the winch toward the pulley end, and vice versa.

In the presently-preferred embodiment, the submersible pumping unit includes a hydraulic motor driving a pump near the intake end of an elongated, rigid, discharge pipe. The cart carries a pump, an engine for driving it, and an oil tank for supplying oil to this pump. The pump on the cart is connected hydraulically to the hydraulic motor in the submersible pumping unit through flexible hoses on the cart and rigid hydraulic lines on the outside of the discharge pipe. The cart carries a basket for holding a folded-up, large diameter, flexible discharge hose for connection to the upper end of the discharge pipe of the submersible pumping unit.

Preferably, also, the winch is driven by a reversible hydraulic motor operated by the pump on the cart. A manual selector valve, mounted on the same platform as the winch and its hydraulic motor, controls the operation of the hydraulic motor for the winch.

A principal object of this invention is to provide a novel and improved mobile pumping apparatus which makes it relatively easy and safe to lower an elongated submersible pumping unit into the water and raise it out of the water.

Further objects and advantages of this invention will be apparent from the following detailed description of a presently-preferred embodiment thereof, which is shown in the accompanying drawings in which:

FIG. 7 is an elevational view of the apparatus showing the submersible pumping unit being lowered into the water;

FIG. 8 is an elevation of a rigid takeoff elbow for attachment to the upper end of the submersible pumping unit;

FIG. 9 is an elevational view of the apparatus with the submersible pumping unit in pumping position in the water and the cable repositioned.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Figure 2:
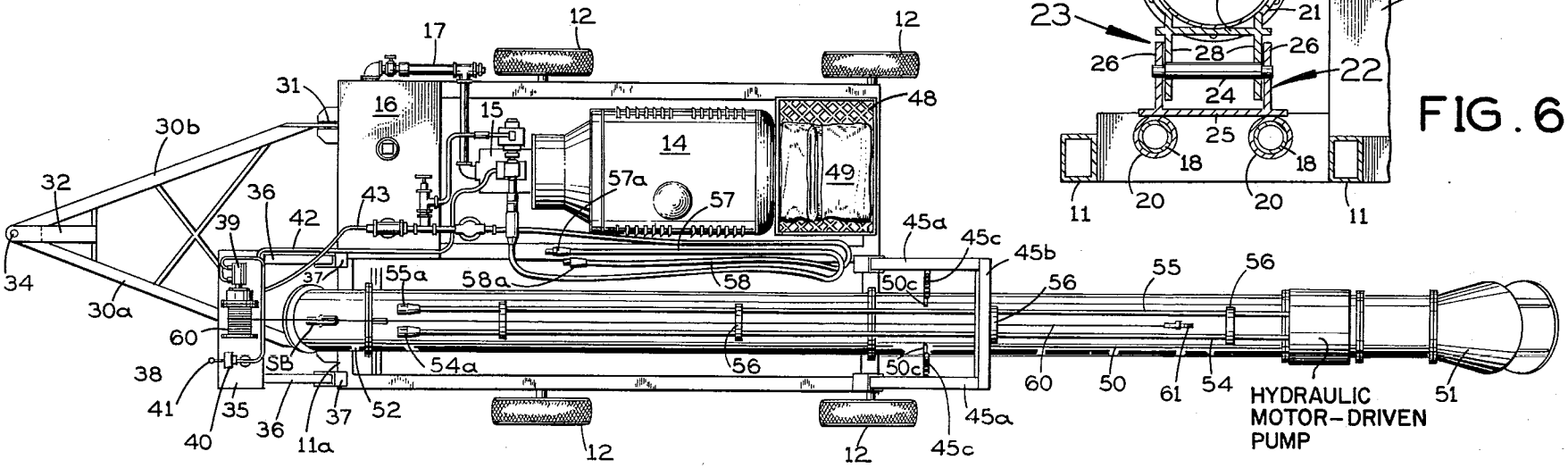
FIG. 2 is a top plan view of the FIG. 1 apparatus.
Figure 3:
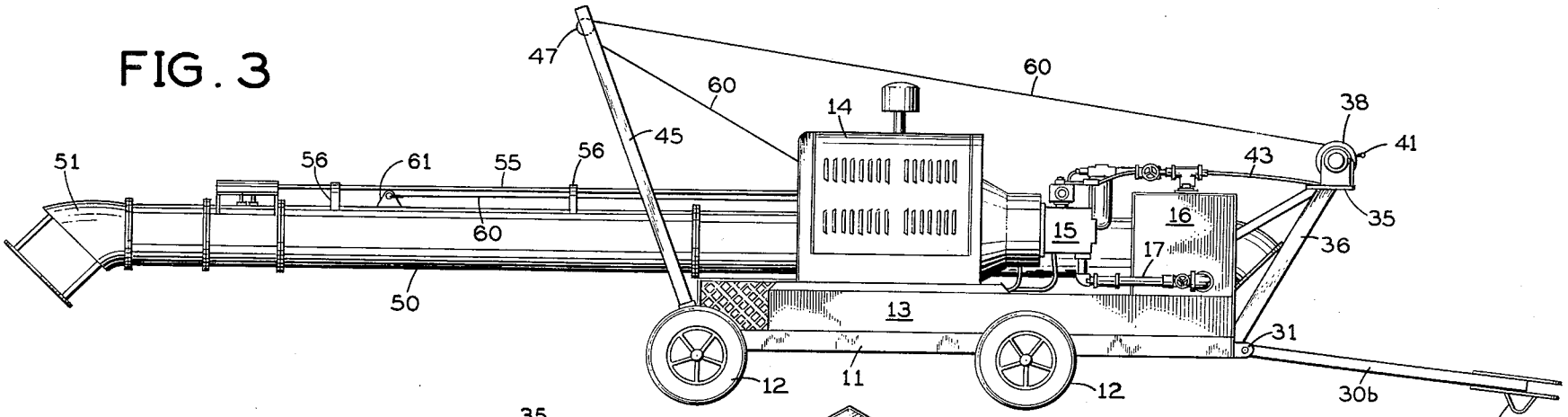
FIG. 3 is a view similar to FIG. 1 but taken from the opposite side of the apparatus.
Figure 5:
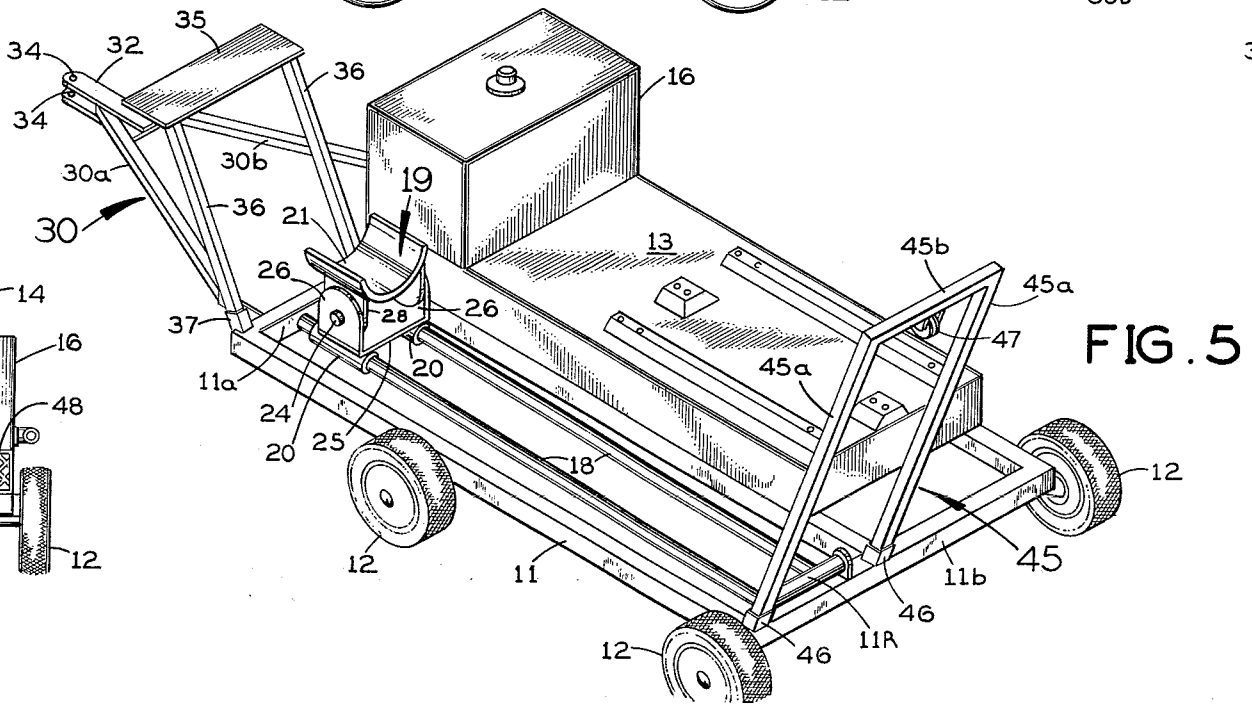
FIG. 5 is a perspective view of the apparatus with the winch, cable and submersible pumping unit removed from clarity.
Figure 4:
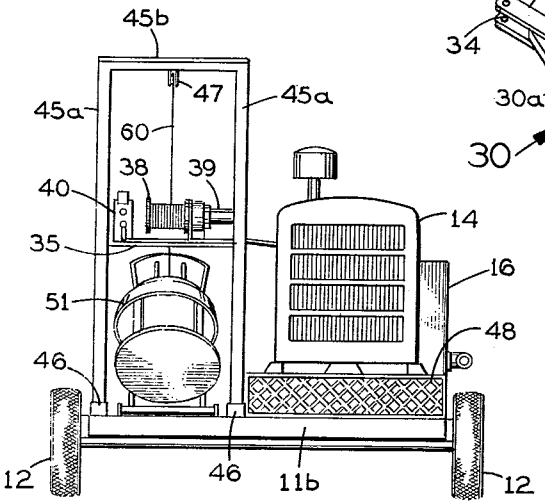
FIG. 4 is a plan view of the apparatus taken from its back end (the right end of FIG. 1)

Referring first to FIG. 5, the present apparatus includes a wheeled cart having a rigid, rectangular, horizontal bottom frame 11 supported a short distance above the ground by four or more ground-engaging wheels 12. At one side the bottom frame of the cart supports a raised horizontal platform 13 on which a diesel engine 14 is mounted, as shown in FIGS. 3 and 4. This engine drives a pump 15 (FIG. 3) which pumps oil out of a storage tank 16 extending up from the front end of the platform 13. The inlet of this pump is connected to the interior of the oil tank 16 near the bottom of the latter by a series of pipes and fittings indicated generally by the reference numeral 17 in FIGS. 2 and 3.

Figure 1:
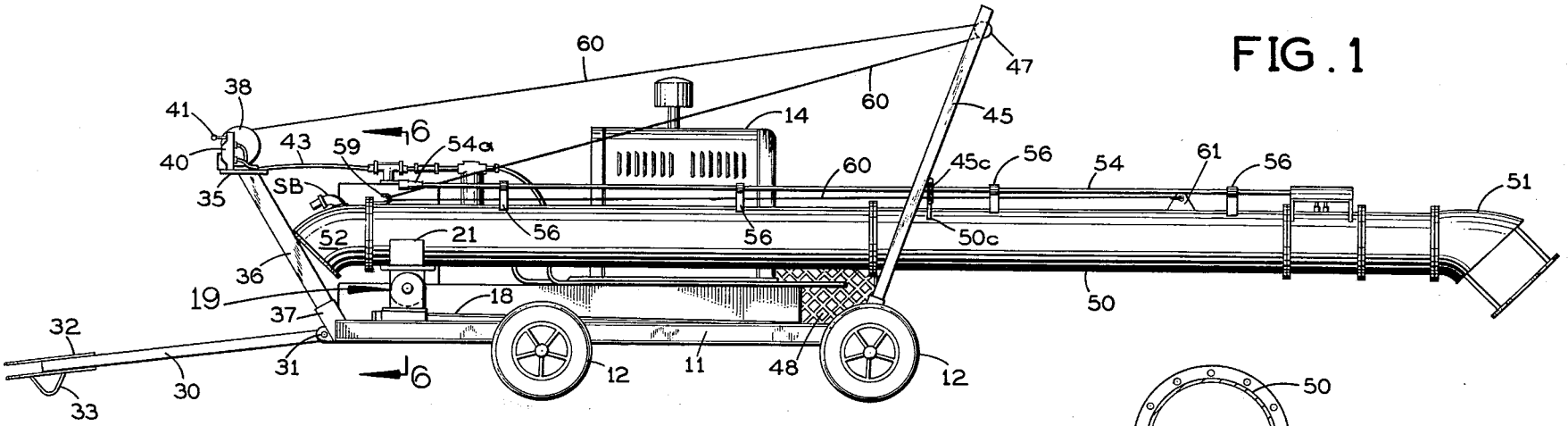
FIG. 1 is a side elevation of the present apparatus.

To the left of the platform 13 in FIG. 1 the bottom frame 11 of the cart supports a pair of laterally spaced rigid guide bars 18, each having a cylindrical periphery and extending longitudinally between the front cross rail 11*a* and the back cross rail 11*b* of the bottom frame. These guide bars 18 are inclined upward at a very small angle from back to front along the cart, as shown in FIG. 1. A pipe-supporting, pivotally articulated slide 19 is slidably mounted on these guide bars 18 for movement between a position close to the front of the cart, as shown in FIG. 5, and a position close to the back, for a purpose explained hereinafter.

Figure 6:
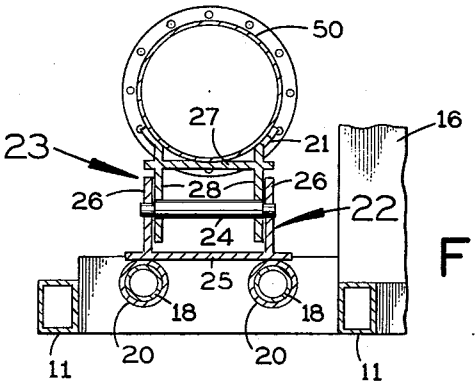
FIG. 6 is a vertical cross-section taken along the line 6—6 in FIG. 1 through the slidably mounted pipe support in the apparatus.

This slide 19 has cylindrical sleeves 20 on the bottom which snugly, but slidably, encircle the respective guide bars 18. At the top the slide presents a partially cylindrical cradle 21 which is concave upwardly for snugly receiving the bottom of a large diameter discharge pipe, as explained hereinafter. As shown in FIG. 6, this cradle 21 extends through an arc of about 120 degrees. Between the sleeves 20 on the bottom and the pipe supporting cradle 21 at the top, the slide 19 comprises a bottom member 22 and a top member 23 (FIG. 6) pivotally connected to each other by a horizontal cross pin 24. The bottom member 22 of the slide has a bottom plate 25, which is welded to the top of the sleeves 20 and extends transversely between them, and a pair of opposite vertical side plates 26, which are welded to the top of the bottom plate 25 and extend up from it at the tranverse locations of the respective guide sleeves 20. The top member 23 of the slide has a horizontal cross plate 27 and a pair of opposite vertical side plates 28 which extend down at the inboard sides of the upstanding side plates 26 on the bottom member 22 of the slide. The side plates 28 project above the cross plate 27 and support the cradle 21 from below. With this arrangement the cradle 21 and the top member 23 of the slide are pivotally adjustable with respect to the bottom member 22 and the guide sleeves 20 about a horizontal axis (at 24) which extends transversely of the cart.

A rigid tow bar unit 30 is pivotally attached to the front end of the bottom frame of the cart. As shown in FIG. 2, this tow bar unit comprises opposite rails 30*a* and 30*b* which converge toward each other in a direction away from the cart. These opposite rails are pivotally attached individually at their back ends to the front cross rail 11*a* of the bottom frame 11 at respective horizontal pivots 31 (FIG. 1). At their front ends the opposite rails 30*a* and 30*b* are rigidly attached to a connector plate assembly 32 which presents a ground-engaging, rounded skid 33 on the bottom. This connector plate assembly 32 projects forward beyond the front ends of the opposite rails 30*a* and 30*b* and presents vertically aligned openings 34 (FIG. 5) which enable it to be pivotally attached to a hitch on the back end of a truck or other vehicle.

Also at the front end of the cart a laterally extending horizontal platform 35 for a winch is supported by rigid, upwardly and forwardly inclined standards 36. The lower ends of these standards are received snugly in corresponding inclined hollow stubs 37 which extend up from the front end of the bottom frame 11 at each side.

A rotatable winch 38 and a reversible hydraulic motor 39 for driving the winch are mounted on top of the platform 35, as shown in FIG. 4. The platform 35 also supports a manually-operated selector valve 40 which controls the operation and the direction of rotation of the hydraulic motor 39. The valve 40 has a three-position control handle 41 (FIG. 1) which may be set for operating the motor 39 in either direction or for turning it off. The winch is provided with a brake (not shown) of conventional design.

The hydraulic motor 39 is connected hydraulically to the engine-driven pump 15 and the oil tank 16 through hoses 42 and 43 (FIG. 2) and fittings, the details of which are not important to an understanding of the present invention.

At the back end of the cart a pulley-supporting boom 45 in inclined upward and rearward from the bottom frame 11 of the cart. As best seen in FIG. 5, this boom is of inverted generally U-shape, with opposite, upwardly and rearwardly inclined side rails 45*a* interconnected at the top by a horizontal cross rail 45*b*. The side rails 45*a* have their lower ends snugly received in inclined hollow stubs 46 which project up from the rear cross rail 11*b* of the bottom frame 11 of the cart. A pulley 47 is suspended below the top cross rail 46*b* of the bottom at a location midway between the side rails 45*a* of the boom. As shown in FIG. 1, the pulley 47 is at a substantially higher level than the platform-mounted winch 38 at the opposite end of the cart.

Suitable braces may extend between the side rails 45*a* of the boom and the corresponding sides of the bottom frame 11. These braces are omitted from the drawings to simplify them.

A basket 48 is mounted on the cart immediately behind the engine 14. As best seen in FIG. 1, the bottom of this basket rests partly on the raised platform 13 and partly on the bottom frame 11 behind the platform 13. As shown in FIG. 2, this basket can hold a folded-up, large diameter, long, flexible fabric hose 49 which in use extends along the ground behind the cart as shown in FIG. 9.

The cart supports an elongated, rigid, generally cylindrical, submersible pumping unit. This pumping unit has a housing which includes a discharge pipe 50 composed of several flanged, rigid, cylindrical pipe sections bolted to each other end to end. An intake bell 51 is bolted to one end of the pipe 50, and a discharge elbow 52 is bolted to its opposite end.

A small elbow SB is attached to the top of the discharge elbow 52. This elbow SB contains a normally-closed gate valve which is exposed at one side to the atmosphere and is exposed at the opposite side to the fluid pressure inside the discharge elbow 52. A spring biases this gate valve to its closed position as long as the pressure inside the discharge elbow 52 equals or exceeds atmospheric pressure. A substantial pressure drop inside the discharge elbow 52 will cause this valve to open automatically to supply atmospheric pressure to the inside of elbow 52, for a purpose explained hereinafter.

In one practical embodiment the length of the pipe 50 between the intake bell 51 and the discharge elbow 52 is about 24 feet and its diameter is about 2 feet.

Located inside the pipe 50 just to the left of the intake bell 51 in FIG. 1 is a hydraulic motor and pump assembly (not shown), which includes a rotary hydraulic motor of known design driving an axial flow pump. In the use of this apparatus, when the pipe 50 (with the intake bell 51 at the lower end) is lowered into a body of water, the hydraulic motor-driven axial flow pump draws water up through the intake bell 51 and discharges it up through the pipe 50 with sufficient pressure to force the water up to the discharge elbow 52 at the upper end of the pipe.

Figure 10:
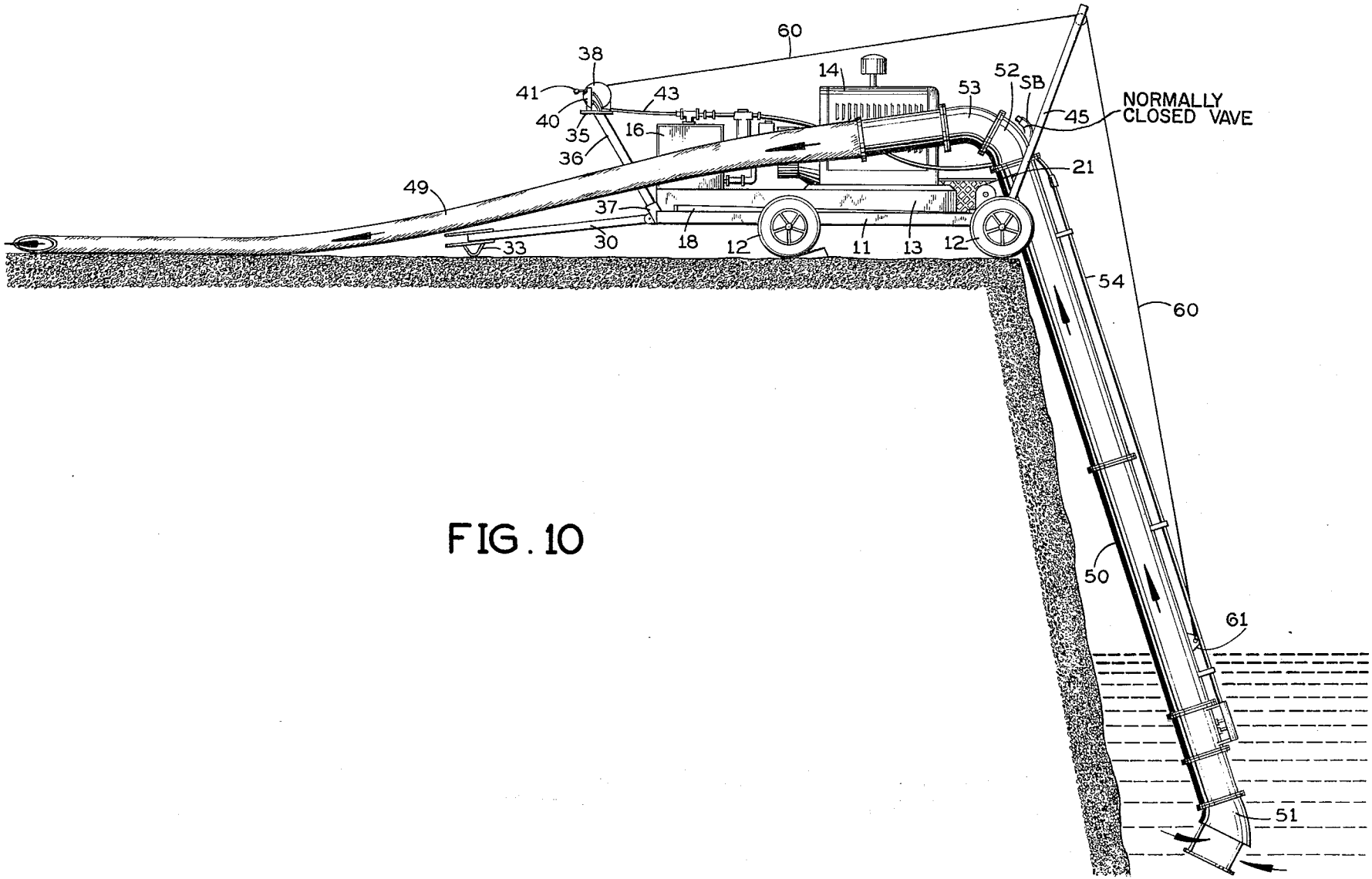
FIG. 10 is a view similar to FIG. 9 but showing the submersible pumping unit extending more vertically into the water.

When the submersible pumping unit is in operation, a detachable, rigid takeoff elbow 53 with the configuration shown in FIG. 8 is connected between the discharge elbow 52 at the upper end of the submersible pumping unit and the flexible hose 49, as shown in FIG. 9, to pass the water coming up through pipe 50 into the hose 49 for discharge onto the ground or disposal in any other fashion desired at the opposite end of hose 49. The takeoff elbow 53 provides a bend which enables the hose 49 to extend to one side of the cart, as shown in FIGS. 9 and 10.

The hydraulic motor inside the discharge pipe 50 near the latter's intake end is supplied with oil under pressure from the above-ground, engine-driven pump 15 on the cart through a rigid supply line 54 which extends along the top of the pipe 50, and from this motor the oil is returned to the cart-mounted tank 16 through a similar line 55 (FIG. 2). The supply and return lines 54, 55 for the hydraulic motor in the submersible pumping unit are supported by brackets 56 attached to the top of the pipe 50 at suitable intervals. A short distance from the discharge elbow 52 the two hydraulic lines 54 and 55 terminate in respective couplings 54*a* and 55*a* (FIG. 2) which are adapted for attachment to complementary couplings 57*a* and 58*a* on the ends of flexible hoses 57 and 58, respectively. The opposite ends of these hoses are connected to fittings which communicate with the discharge side of the cart-mounted pump 15 and the oil tank 16.

The discharge pipe 50 containing the submersible hydraulic motor and axial flow pump is lowered into the body of water and lifted from it by means of a cable 60 (FIG. 1) that is wound around the motor-driven winch 38. One end of this cable is connected to the winch and the opposite end is attached to a fitting 61 that projects up from the pipe 50 toward the end where the intake bell 51 is located. In certain circumstances, as explained hereinafter, cable 60 extends from the winch 38 back up across the top of the pulley 47 at the back end of the cart, then forward and downward around a hook 59 or other cable guide on the top of the discharge pipe 50 just behind its discharge elbow 52, and from this hook lengthwise along the top of the discharge pipe 50 to the fitting 61. At other times the cable 60 does not engage the hook 59 but goes directly from the pulley 47 to the fitting 61 on pipe 50.

Before the submersible pumping unit is put into use, the slide 19 is retracted to the front end of the cart, as shown in FIG. 1. The section of the discharge pipe 50 next to the discharge elbow 52 rests on the slide-mounted cradle 21. From this cradle the pipe 50 extends lengthwise over the cart, passing freely through and beyond the pulley-supporting boom 45, as shown in FIGS. 1 and 2.

Two chains **45*c* (FIG. 2) extend from the opposite sides 45*a* of the pulley-supporting boom 45 over to respective fittings 50*c* on the discharge pipe 50 about midway along its length. These chains hold the discharge pipe 50 in place on the cart. The chains are readily detachable manually from the discharge pipe 50** to permit it to be lowered into the water.

At the water's edge the chains **45*c* are disconnected from the discharge pipe, and the winch 38 now is operated in a direction to pull the discharge pipe 50 and the slide 19 in unison from left to right along the cart in FIGS. 1 and 7. The downward inclination of the guide bars 18 facilitates this sliding movement of slide 19. As this action proceeds the pipe 50 slides over a transverse horizontal roller 11R (FIG. 5) on the back end of the cart. The intake end of the discharge pipe 50 gradually moves down into the water as this pipe is slid off the back end of the cart, and simultaneously the upper half 23 of the slide 19 pivots clockwise in FIG. 7 under the weight of the unsupported end of the discharge pipe 50. Due to this pivotal movement the cradle 21 continues in full engagement with the pipe 50** from below near its discharge end.

After the discharge pipe 50 has reached the position shown in phantom in FIG. 7 the cable 60 may be disengaged from the hook 59, so that (after being made taut again by the winch 38) it will extend down from the pulley 47 straight to its attachment at 61 to the discharge pipe 50, as shown in FIG. 9. The cradle 21 continues to snugly engage the pipe 50 from below near its upper (discharge) end while the cable 60 supports the weight of the submersible unit beyond the cart (to the extent that it exceeds the buoyant effect of the water).

Now the takeoff elbow 53 may be attached to the discharge elbow 52 on the upper end of the discharge pipe 50, and the discharge hose 49 may be connected to the takeoff elbow 53. As shown in FIGS. 9 and 10, the hose 49 extends away from the cart along the ground to a location where the water pumped up out of the body of water will be discharged.

As shown in FIG. 9, the discharge pipe 50 may extend down into the water at a relatively small angle or, as shown in FIG. 10, it may extend almost vertically down into the water. The pivoted cradle 21 permits virtually any desired adjustment of the discharge pipe 50 over an angular range of almost 90°.

When the output of the engine-driven pump 15 on the cart is connected to the submerged hydraulic motor inside the discharge pipe 50 near its intake end, this motor drives the submerged pump inside the pipe 50 to pump water up through this pipe and from its discharge end through the discharge hose 49.

Whenever the pump 15 on the cart is turned off or is disconnected from the hydraulic motor in the submersible pumping unit there is a tendency for the water inside the discharge pipe 50 above this motor to surge down through the pipe by gravity. Such a downward surge of water might tend to reduce the pressure inside the discharge hose 49 enough to cause this hose to collapse. However, this is avoided by the automatic opening of the previously-mentioned gate valve inside the small elbow SB mounted on the discharge elbow 52 at the upper end of the discharge pipe 50.

When the pumping operation is over, the winch 38 may be operated to raise the submerged pipe 50 out of the water. The pipe-supporting cradle 21 automatically adjusts itself pivotally during such lifting of the pipe 50 so as to maintain its supportive engagement with this pipe near its discharge end. As the length of the cable 60 beyond the winch 38 is shortened, the slide 19 moves along the guide bars 18 from the back end of the cart toward its front end.

After the discharge pipe 50 has been pulled back up far enough, the chains **45*c* are again hooked to the fittings 50*c* on pipe 50** to hold the pipe on the cart.

It may be noted that the hydraulic motor need not be located at the intake end of the pipe 50. For example, it may be at the discharge end with a shaft running to the propellor.

I claim:

1. In a movable pumping apparatus for pumping water out of a body of water in the ground, the combination of:

a submersible pumping unit comprising an elongated, rigid discharge pipe having an intake end for insertion down into the body of water and an opposite discharge end, said discharge pipe containing a hydraulic motor-driven pump for pumping the water up through the pipe from its intake end to its discharge end;

a wheeled cart for holding the discharge pipe near the body of water;

a power-operated winch on said cart, and a cable operated by the winch and attachable to the discharge pipe for raising and lowering the intake end of the discharge pipe and suspending the pipe in the body of water;

a pipe support supporting the discharge pipe from below near its discharge end;

and means horizontally pivoting said pipe support on the cart for angular adjustment in unison with the discharge pipe as its intake end is lowered or raised by the winch-operated cable.

2. An apparatus according to claim 1, wherein said last-mentioned means is a slide which is slidable along the cart substantially horizontally.

3. An apparatus according to claim 1, and further comprising chain means on said cart releasably attachable to said discharge pipe away from its discharge end to hold said pipe on the cart.

4. An apparatus according to claim 2, and further comprising a horizontal roller on the cart extending transversely below the discharge pipe between said slide and the intake end of the discharge pipe for slidably supporting the discharge pipe from below as its intake end is lowered into the water.

5. An apparatus according to claim 4, wherein:

said cart has a pair of laterally spaced guide bars extending substantially horizontally lengthwise of the cart at one side of said roller;

said slide has guide members on the bottom which slidably engage said guide bars;

and said slide has lower and upper members pivotally connected to each other for pivotal adjustment of the upper member about a horizontal axis extending transversely above said guide bars.

6. An apparatus according to claim 1, wherein said submersible pumping unit includes a hydraulic motor inside said discharge pipe driving said pump, and further comprising:

an engine on said cart;

a pump on said cart driven by said engine;

an oil tank on said cart connected hydraulically to the inlet of said last-mentioned pump;

a pair of flexible hydraulic hoses connected respectively to the outlet of said last-mentioned pump and to said oil tank;

and a pair of hydraulic lines extending lengthwise along the outside of said discharge pipe from a location near the latter's discharge end to the respective opposite sides of the hydraulic motor in said submersible pumping unit;

said hoses and said hydraulic lines having couplings for connecting them together to supply oil from said pump on the cart to said hydraulic motor in said submersible pumping unit and to return the oil from said hydraulic motor to said oil tank on the cart.

7. An apparatus according to claim 1, and further comprising:

a long, flexible, large diameter, discharge hose for attachment to said discharge pipe at its discharge end;

and means on said cart for holding said last-mentioned hose folded up when it is disconnected from said discharge pipe.

8. Apparatus according to claim 7, and further comprising:

a normally-closed valve in said discharge pipe near its discharge end, said valve being connected between the interior of said discharge pipe and the atmosphere and being operable to open automatically to supply atmospheric pressure to the interior of said discharge pipe and thereby prevent said flexible discharge hose from collapsing when the pressure inside said discharge pipe drops substantially below atmospheric pressure.

9. Apparatus according to claim 1, and further comprising:

a platform supporting said winch;

means positioning said platform at the front end of said cart substantially higher than said pipe support;

a pulley engaged by said cable between said winch and the cable's attachment to the discharge pipe;

and means supporting said pulley at the back end of the cart substantially higher than the winch.

10. Apparatus according to claim 9, and further comprising:

a pair of chains connected respectively to said last-mentioned means on opposite sides of the discharge pipe, said chains being releasably attachable to the discharge pipe to hold the latter on the cart.

11. Apparatus according to claim 10, and further comprising:

an engine on said cart;

a pump on said cart driven by said engine;

an oil tank on said cart connected hydraulically to the inlet of said last-mentioned pump;

a hydraulic motor driving the winch;

and means for hydraulically connecting said hydraulic motor between the outlet of said pump on the cart and said oil tank on the cart.

12. Apparatus according to claim 11, wherein:

said last-mentioned hydraulic motor is reversible and is supported by the platform for the winch;

and further comprising:

a manual selector valve supported by said platform for the winch and operatively connected to said hydraulic motor to control the latter's operation.

13. Apparatus according to claim 12, wherein said submersible pumping unit includes a hydraulic motor inside said discharge pipe driving said pump therein, and further comprising:

a pair of flexible hydraulic hoses connected respectively to the outlet of said pump on the cart and said oil tank;

and a pair of rigid, hydraulic lines extending lengthwise along the outide of said discharge pipe from a location near the latter's discharge end to the respective opposite sides of the hydraulic motor in said submersible pumping unit;

said hoses and said hydraulic lines having couplings for connecting them together to supply oil from said pump on the cart to said hydraulic motor in the submersible pumping unit and to return the oil from said last-mentioned hydraulic motor to said oil tank on the cart.

14. An apparatus according to claim 13, and further comprising:

a long, flexible, large diameter, discharge hose for attachment to said discharge pipe at its discharge end;

and a basket on said cart for holding said lastmentioned hose folded up when it is disconnected from said discharge pipe.

15. An apparatus according to claim 14, wherein:

said means pivoting said pipe support on the cart is a slide which is slidable along the cart substantially horizontally.

16. An apparatus according to claim 15, and further comprising a horizontal roller on the cart extending transversely below the discharge pipe between said slide and the intake end of the discharge pipe for slidably supporting the discharge pipe from below as its intake end is lowered into the water.

17. An apparatus according to claim 15, wherein:

said cart has a pair of laterally spaced guide bars extending substantially horizontally lengthwise of the cart at one side of said roller;

said slide has guide members on the bottom which slidably engage said guide bars;

and said slide has lower and upper members pivotally connected to each other for pivotal adjustment of the upper member about a horizontal axis extending transversely above said guide bars.

18. In a mobile apparatus for use with a hydraulically driven submersible pumping unit comprising an elongated, rigid discharge pipe with an intake end for insertion down into a body of water and an opposite discharge end, said discharge pipe containing a hydraulic motor-driven pump for pumping the water up through the pipe from its intake end of its discharge end, the combination of:

a wheeled cart for holding the discharge pipe near the body of water;

a power-operated winch on said cart, and a cable operated by the winch and attachable to the discharge pipe for raising and lowering the intake end of the discharge pipe and suspending the pipe in the body of water;

a pipe support for supporting the discharge pipe from below near its discharge end;

and means horizontally pivoting said pipe support on the cart for angular adjustment in unison with the discharge pipe as its intake end is lowered or raised by the winch-operated cable.

19. An apparatus according to claim 18, wherein said last-mentioned means is a slide which is slidable along the cart substantially horizontally.

20. An apparatus according to claim 18, and further comprising chain means on said cart releasably attachable to the discharge pipe away from its discharge end to hold said pipe on the cart.

21. An apparatus according to claim 19, and further comprising a horizontal roller on the cart for engaging the discharge pipe transversely between its intake end and said slide as the intake end is lowered into the water.

22. An apparatus according to claim 21, wherein:

said cart has a pair of laterally spaced guide bars extending substantially horizontally lengthwise of the cart at one side of said roller;

said slide has guide members on the bottom which slidably engage said guide bars;

and said slide has lower and upper members pivotally connected to each other for pivotal adjustment of the upper member about a horizontal axis extending transversely above said guide bars.

23. Apparatus according to claim 18, and further comprising:

a platform supporting said winch;

means positioning said platform at the front end of said cart substantially higher than said pipe support;

a pulley engaged by said cable between said winch and the cable's attachment to the discharge pipe;

and means supporting said pulley at the back end of the cart substantially higher than the winch.

24. Apparatus according to claim 23, and further comprising:

a pair of chains connected respectively to said last-mentioned means on opposite sides of the discharge pipe, said chains being releasably attachable to the discharge pipe to hold the latter on the cart.

25. Apparatus according to claim 24, and further comprising:

an engine on said cart;

a pump on said cart driven by said engine;

an oil tank on said cart connected hydraulically to the inlet of said last-mentioned pump;

a hydraulic motor driving the winch;

and means for hydraulically connecting said hydraulic motor between the outlet of said pump on the cart and said oil tank on the cart.

26. Apparatus according to claim 25, wherein:

said last-mentioned hydraulic motor is reversible and is supported by the platform for the winch;

and further comprising:

a manual selector valve supported by said platform for the winch and operatively connected to said hydraulic motor to control the latter's operation.

27. An apparatus according to claim 26, wherein:

said cart has a pair of laterally spaced guide bars extending substantially horizontally lengthwise of the cart;

said slide has guide members on the bottom which slidably engage said guide bars;

and said slide has lower and upper members pivotally connected to each other for pivotal adjustment of the upper member about a horizontal axis extending transversely above said guide bars;

and further comprising:

a horizontal transverse roller on the cart at one end of said guide bars for slidably supporting the discharge pipe from below as its intake end is lowered into the water.

* * * * *